US008319716B2

(12) United States Patent
Kim et al.

(10) Patent No.: US 8,319,716 B2
(45) Date of Patent: Nov. 27, 2012

(54) LIQUID CRYSTAL DISPLAY WITH AUXILIARY LINES AND METHOD OF DRIVING THE SAME

(75) Inventors: Shawn Kim, Suwon-si (KR); Chul-Woo Park, Suwon-si (KR); Sam-Ho Ihm, Suwon-si (KR); Mitsuru Fujii, Suwon-si (KR); Jin-Woo Park, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 723 days.

(21) Appl. No.: 12/165,318

(22) Filed: Jun. 30, 2008

(65) Prior Publication Data

US 2009/0121995 A1 May 14, 2009

(30) Foreign Application Priority Data

Nov. 8, 2007 (KR) ..... 10-2007-0113465

(51) Int. Cl.
*G09G 3/36* (2006.01)

(52) U.S. Cl. ..... 345/96

(58) Field of Classification Search ..... 345/96
See application file for complete search history.

(56) References Cited

U.S. PATENT DOCUMENTS

| | | | | |
|---|---|---|---|---|
| 2002/0089485 | A1* | 7/2002 | Youn | 345/99 |
| 2005/0122441 | A1* | 6/2005 | Shimoshikiryoh | 349/38 |
| 2006/0176255 | A1* | 8/2006 | Do et al. | 345/87 |
| 2006/0187164 | A1* | 8/2006 | Okuno | 345/92 |

FOREIGN PATENT DOCUMENTS

| | | |
|---|---|---|
| JP | 2004-240263 | 8/2004 |
| KR | 2003-0083311 | 10/2003 |
| KR | 10-2004-0062149 | 7/2004 |
| KR | 10-2006-0063306 | 6/2006 |

(Continued)

OTHER PUBLICATIONS

Korean Patent Abstracts, Publication No. 1020030083311 A; Date of Publication: Oct. 30, 2003; in the name of Hong Seong Song, et al.

(Continued)

*Primary Examiner* — Chanh Nguyen
*Assistant Examiner* — Robert Stone
(74) *Attorney, Agent, or Firm* — Christie, Parker & Hale, LLP

(57) ABSTRACT

A liquid crystal display (LCD) and method for driving the LCD using one or more polarity inversion methods is provided. In one embodiment, the invention relates to a method of driving an LCD comprising a liquid crystal panel partitioned by a plurality of gate lines and data lines and including a plurality of liquid crystal cells arranged in a matrix and auxiliary lines adjacent to and parallel to the gate lines, the auxiliary lines coupled with the plurality of liquid crystal cells, the method including supplying an auxiliary voltage that increases from a low level to a high level on a first pair of auxiliary lines adjacent to each other for a jth frame period, supplying an auxiliary voltage that decreases from a high level to a low level on a second pair of auxiliary lines adjacent to each other for the jth frame period, supplying the auxiliary voltages at levels opposite to the levels of the jth frame period on the first and second pairs of auxiliary lines in a (j+1)th frame period.

12 Claims, 8 Drawing Sheets

FOREIGN PATENT DOCUMENTS

KR 10-2007-0071687 7/2007

OTHER PUBLICATIONS

Korean Patent Abstracts, Publication No. 1020060063306 A; Date of Publication: Jun. 12, 2006; in the name of Do Yeon Kim, et al.

Korean Patent Abstracts, Publication No. 1020070071687 A; Date of Publication: Jul. 4, 2007; in the name of Young Soo Ha.

Korean Office action dated May 11, 2009, for priority Korean application 10-2007-0113465, noting listed references in this IDS.

* cited by examiner

FIG. 2A (Related Art)

| | | | | | | | |
|---|---|---|---|---|---|---|---|
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |

FIG. 2B (Related Art)

| | | | | | | | |
|---|---|---|---|---|---|---|---|
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |

FIG. 3A (Related Art)

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

FIG. 3B (Related Art)

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |

FIG. 4A (Related Art)

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG. 4B (Related Art)

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

| | | | | | | | |
|---|---|---|---|---|---|---|---|
| + | − | + | − | + | − | + | − |
| + | + | + | + | + | + | + | + |
| − | + | − | + | − | + | − | + |
| − | − | − | − | − | − | − | − |
| + | − | + | − | + | − | + | − |
| + | + | + | + | + | + | + | + |
| − | + | − | + | − | + | − | + |
| − | − | − | − | − | − | − | − |

FIG. 10

| | | | | | |
|---|---|---|---|---|---|
| + | − | + | − | + | − |
| + | − | + | − | + | − |
| + | − | + | − | + | − |
| + | − | + | − | + | − |

LIQUID CRYSTAL DISPLAY WITH AUXILIARY LINES AND METHOD OF DRIVING THE SAME

CROSS-REFERENCE TO RELATED APPLICATION

This application claims priority to and the benefit of Korean Patent Application No. 10-2007-0113465, filed on Nov. 8, 2007, in the Korean Intellectual Property Office, the entire content of which is incorporated herein by reference.

BACKGROUND OF THE INVENTION

1. Field of the Invention

The present invention relates to a liquid crystal display (LCD) and a method of driving the same, and more particularly, relates to driving an LCD using one or more polarity inversion methods.

2. Description of the Related Art

Liquid crystal displays (LCDs) control transmittances in liquid crystal cells in accordance with data signals to display an image. The LCD often includes a liquid crystal panel on which the liquid crystal cells are arranged in a matrix and a driving circuit for driving the liquid crystal panel.

FIG. 1 is a block diagram illustrating a conventional LCD.

Referring to FIG. 1, the conventional LCD includes a liquid crystal panel 2 on which the liquid crystal cells are arranged in a matrix, a gate driver 4 for driving gate lines GL1 to GLn of the liquid crystal panel 2, and a data driver 6 for driving data lines DL1 to DLm of the liquid crystal panel 2.

The liquid crystal panel 2 includes thin film transistors (TFT) formed at the crossing regions of the n gate lines GL1 to GLn and the m data lines DL1 to DLm.

The TFTs are used to control whether data signals from the data lines DL1 to DLm are provided to the liquid crystal cells in response to gate signals from the gate lines GL1 to GLn.

The liquid crystal cells can be equivalently represented by liquid crystal capacitors Clc including common electrodes that face each other with liquid crystal interposed and pixel electrodes coupled with the TFTs. A storage capacitor (not shown) for maintaining the voltage of a data signal stored in the liquid crystal capacitor until a next data signal is supplied, is further formed in each of the liquid crystal cells. The storage capacitor can be formed between the gate electrode and the pixel electrode.

The gate driver 4 sequentially supplies gate signals to the gate lines GL1 to GLn so that the TFTs coupled with the corresponding gate lines are driven.

The data driver 6 converts digital data to analog data signals and supplies video signals for one horizontal line to the data lines DL1 to DLm in one horizontal period where the gate signals are supplied to the gate lines GL. The data driver 6 converts the digital data into data signals using gamma voltages supplied from a gamma voltage generator (not shown) to generate the data signals.

In order to prevent the liquid crystal cells from deteriorating and to improve picture quality, in driving the liquid crystal cells on the liquid crystal panel, an inversion method is often used. The inversion method generally includes a frame inversion method, a line inversion method, a column inversion method, or a dot inversion method.

In the frame inversion method, the polarity of video signals supplied to the liquid crystal cells on the liquid crystal panel is inverted whenever a frame is changed. However, since the data signals of the same polarity are supplied to an entire frame, it is not advantageous in preventing liquid crystal cells from deteriorating.

In addition, in the line inversion method, the polarity of the data signals supplied to the liquid crystal panel is inverted in each of the gate lines on the liquid crystal panel and in each frame as illustrated in FIGS. 2A and 2B. In such case, crosstalk often exists between horizontal pixels. Consequently, flicker in the form of stripes is generated between horizontal lines. In addition, an alternating current (AC) voltage source having a predetermined driving frequency is often used. As a result, the LCD display using the line inversion method produces vibration causing audible noise.

In the column inversion method, the polarity of the video signals supplied to the liquid crystal panel is inverted in the data lines on the liquid crystal panel and in each frame as illustrated in FIGS. 3A and 3B. Crosstalk is often generated between vertical pixels. The crosstalk causes flicker in the form of stripes between vertical lines.

In the dot inversion method, as illustrated in FIGS. 4A and 4B, video signals of opposite polarities are supplied to all of the horizontally and vertically adjacent liquid crystal cells such that the polarity of the video signals is inverted in each adjacent frame. Since flicker generated between the vertically and horizontally adjacent pixels is offset, higher quality image is produced using the dot inversion method in comparison with the other inversion methods.

However, in the dot inversion method, the polarity of the data signals supplied from the data driver to the data lines is horizontally and vertically inverted. Therefore, since the change in pixel voltage and frequency from one pixel to another is larger than the change in the other inversion methods, power consumption increases.

SUMMARY OF THE INVENTION

The invention relates to a system and method for driving an LCD. In several embodiments, the invention employs inversion methods to reduce or prevent crosstalk, flicker, and audible noise and to reduce power consumption. In one embodiment, the invention relates to a liquid crystal display (LCD), comprising a liquid crystal panel partitioned by a plurality of gate lines orthogonal to a plurality of data lines comprising odd data lines and even data lines, the panel including a plurality of liquid crystal cells arranged in a matrix and auxiliary lines adjacent to and parallel to the gate lines, the auxiliary lines configured to couple with at least one of the plurality of liquid crystal cells, and an auxiliary driver for driving the auxiliary lines arranged on the liquid crystal panel, wherein each of the liquid crystal cells comprises an auxiliary capacitor, wherein the auxiliary lines comprise odd auxiliary lines and even auxiliary lines, wherein each of the odd auxiliary lines is coupled to the auxiliary capacitor in each of the liquid crystal cells on opposite sides of the odd auxiliary line, where the liquid crystal cells on opposite sides of the odd auxiliary line are coupled to one of the odd data lines, and wherein each of the even auxiliary lines is coupled to the auxiliary capacitor in each of the liquid crystal cells on opposite sides of the even auxiliary line, where the liquid crystal cells on opposite sides of the even auxiliary line are coupled to one of the even data lines.

In another embodiment, the invention relates to a method of driving an LCD comprising a liquid crystal panel partitioned by a plurality of gate lines and data lines and including a plurality of liquid crystal cells arranged in a matrix and auxiliary lines adjacent to and parallel to the gate lines, the auxiliary lines coupled with the plurality of liquid crystal cells, the method including supplying an auxiliary voltage that increases from a low level to a high level on a first pair of auxiliary lines adjacent to each other for a jth frame period, supplying an auxiliary voltage that decreases from a high level to a low level on a second pair of auxiliary lines adjacent to each other for the jth frame period, supplying the auxiliary voltages at levels opposite to the levels of the jth frame period on the first and second pairs of auxiliary lines in a (j+1)th frame period.

BRIEF DESCRIPTION OF THE DRAWINGS

These and/or other embodiments and features of the invention will become apparent and more readily appreciated from the following description of certain embodiments, taken in conjunction with the accompanying drawings of which:

FIGS. 2A and 2B illustrate the polarity of cells in an LCD using the line inversion driving method;

FIGS. 3A and 3B illustrate the polarity of cells in an LCD using the column inversion driving method;

FIGS. 4A and 4B illustrate the polarity of cells in an LCD using the dot inversion driving method;

FIG. 10 illustrates the polarity of cells in an LCD using the inversion driving method of FIG. 9.

DETAILED DESCRIPTION OF EXEMPLARY EMBODIMENTS

Figure 1:
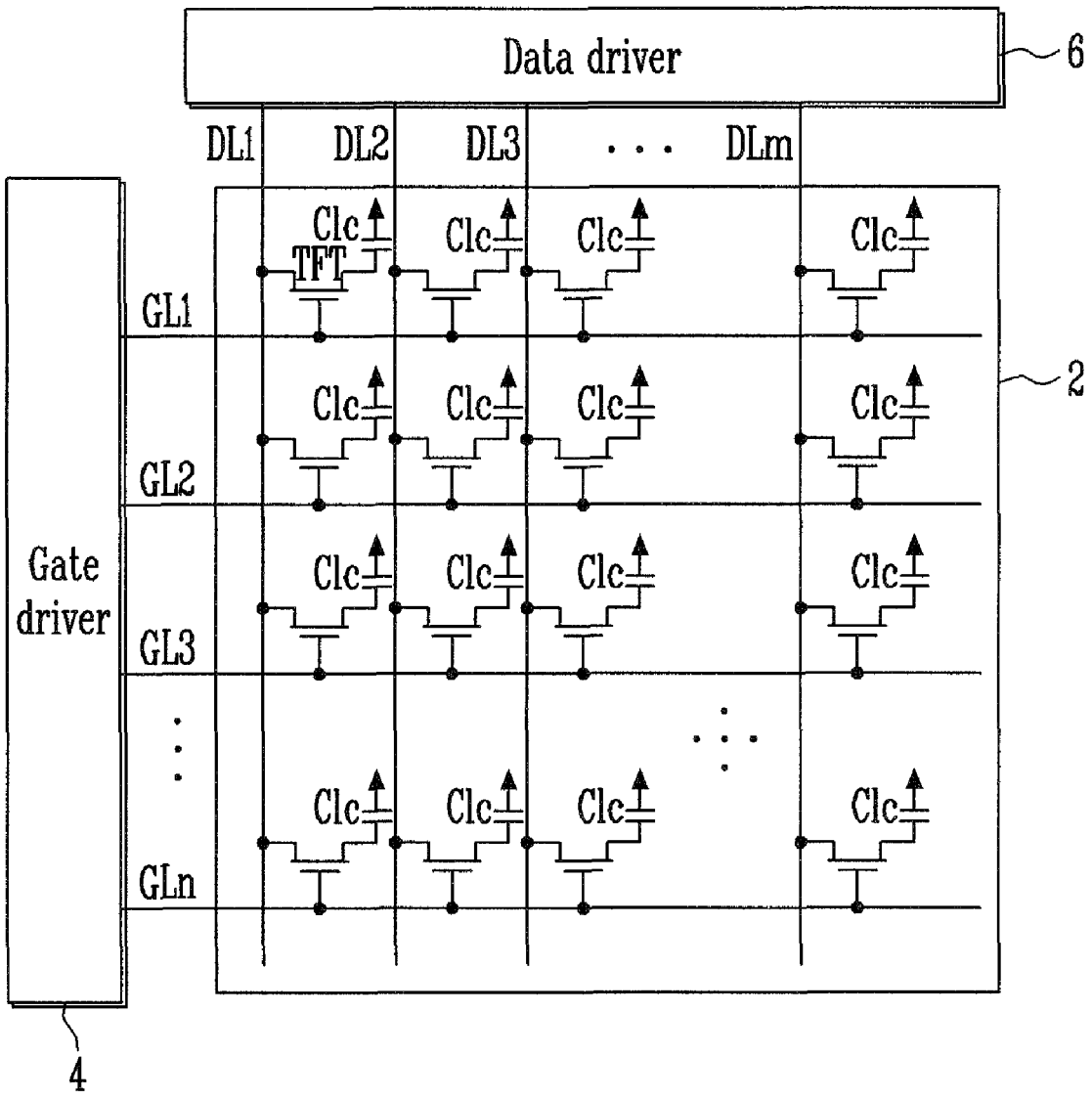
FIG. 1 (PRIOR ART)
FIG. 1 is a block diagram illustrating a conventional liquid crystal display (LCD)

Hereinafter, embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention are omitted for clarity. Also, like reference numerals refer to like elements throughout.

Figure 5:
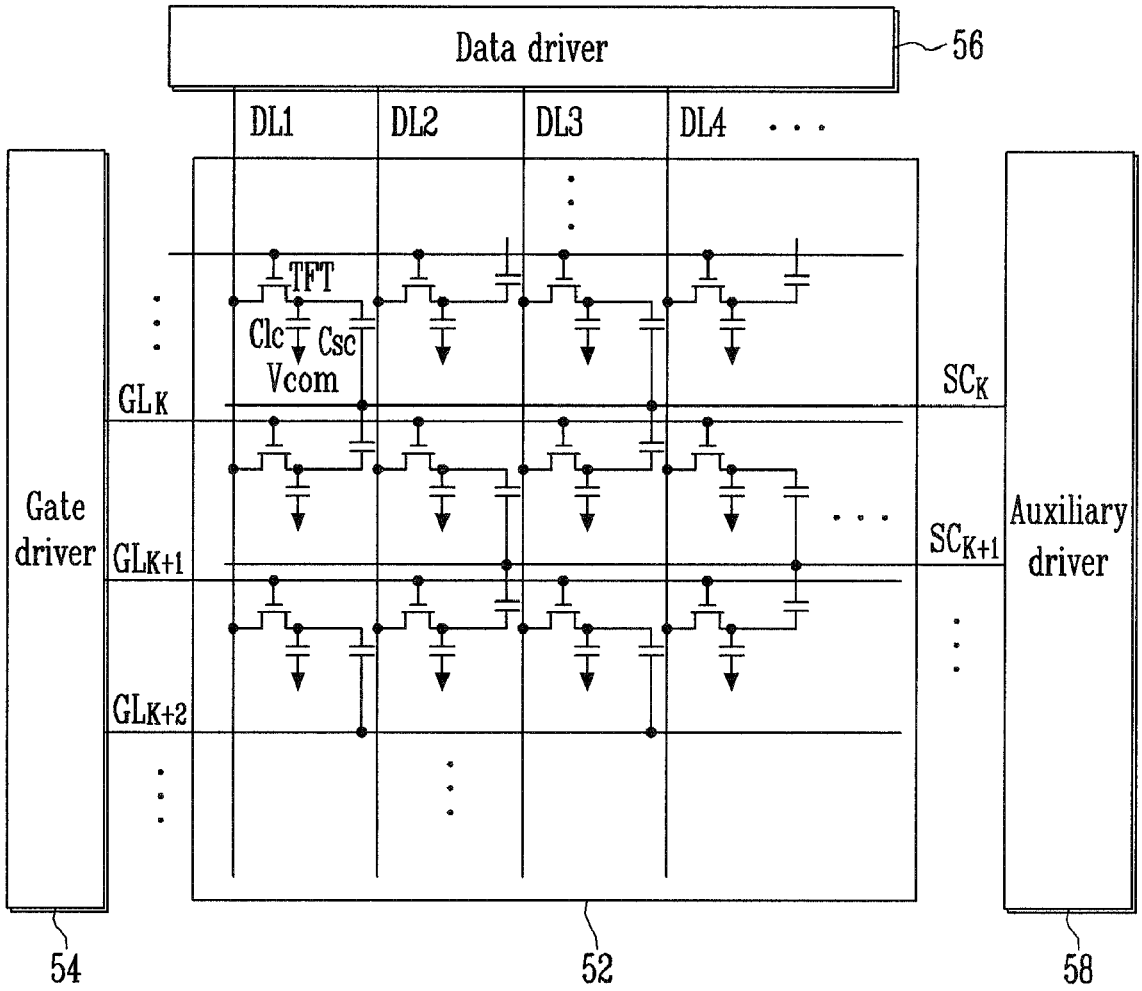
FIG. 5 is a schematic block diagram of an LCD according to an embodiment of the present invention.

FIG. 5 is a schematic block diagram of an LCD according to an embodiment of the present invention.

Referring to FIG. 5, an LCD according to an embodiment of the present invention includes a liquid crystal panel 52 on which liquid crystal cells are arranged in a matrix, a gate driver 54 for driving the gate lines GL of the liquid crystal panel 52, a data driver 56 for driving the data lines DL of the liquid crystal panel 52, and an auxiliary driver 58 for driving the auxiliary lines SC of the liquid crystal panel.

The liquid crystal panel 52 includes thin film transistors TFTs formed at the crossing regions between the gate lines GL and the data lines DL. The TFTs supply data signals from the data lines DL1 to DLm to the liquid crystal cells in response to (e.g., once turned on by) gate signals from the gate lines GL1 to GLn. The liquid crystal cells can be equivalently represented using common electrodes Vcom that face each other with liquid crystal interposed and liquid crystal capacitors Clc including pixel electrodes coupled with the TFTs.

In addition, according to an embodiment of the present invention, an auxiliary capacitor Csc is further included in each of the liquid crystal cells and auxiliary lines SC that provide a suitable voltage (e.g., a predetermined voltage) to the auxiliary capacitors Csc are provided. The auxiliary lines SC are commonly coupled with the auxiliary capacitors Csc included in the liquid crystal cells adjacent to, or on opposite sides of, the particular auxiliary line.

That is, a kth auxiliary line (SCk, where k is an odd number) is adjacent to and parallel to a kth gate line GLk. The kth auxiliary line is commonly coupled with the auxiliary capacitor in the liquid crystal cell, on opposite sides of the kth auxiliary line among all of the liquid crystal cells coupled with the odd data lines DL1, DL3, . . . , and DL2*m*−1 that intersect the kth auxiliary line SCk. In addition, a (k+1)th auxiliary line SCk+1 is adjacent to and parallel to a (k+1)th gate line GLk+1. The (k+1)th auxiliary line SCk+1 is commonly coupled with the auxiliary capacitors Csc in the liquid crystal cells on opposite sides of the (k+1)th auxiliary line SCk+1 among all of the liquid crystal cells coupled with the even data lines DL2, DL4, . . . that cross the (k+1)th auxiliary line SCk+1.

That is, odd auxiliary lines SC1, SC3, . . . adjacent to and parallel with odd gate lines GL1, GL3, . . . are commonly coupled with the auxiliary capacitors Csc in the liquid crystal cells on opposite sides of the odd auxiliary lines SC1, SC3, . . . among all of the liquid crystal cells coupled with odd data lines DL1, DL3, . . . that intersect the auxiliary lines SC1, SC3, . . . .

In addition, even auxiliary lines SC2, SC4, . . . adjacent to and parallel to even gate lines GL2, GL4, . . . are commonly coupled with the auxiliary capacitors Csc in the liquid crystal cells on opposite sides of the even auxiliary lines SC2, SC4, among all of the liquid crystal cells coupled with even data lines DL2, DL4, . . . that cross the auxiliary lines SC2, SC4, . . . .

The structure of the liquid crystal cells will be described in more detail. The gate electrodes of the TFTs included in the liquid crystal cells are coupled with the gate lines GL adjacent to the liquid crystal cells and the drain electrodes of the TFTs are coupled with the data lines DL adjacent to the liquid crystal cells. In addition, the source electrodes of the TFTs are coupled with the first electrodes of the liquid crystal capacitors Clc and the second electrodes of the liquid crystal capacitors Clc are coupled with the common electrodes Vcom.

In addition, according to an embodiment of the present invention, the first electrode of the auxiliary capacitor (Csc) is coupled with the source electrode of the TFT. The second electrode of the auxiliary capacitor (Csc) is coupled with a predetermined auxiliary line SC as described above.

The gate driver 54 sequentially supplies gate signals to the gate lines GLs so that the TFTs coupled with the corresponding gate lines GLs are driven.

The data driver 56 converts digital data to analog data signals and supplies video signals of one horizontal line to the data lines in one horizontal period where the gate signals are supplied to the gate lines GL. The data driver 56 converts the digital data to the data signals using gamma voltages supplied by a gamma voltage generator (not shown) to supply the data signals.

Figure 6:
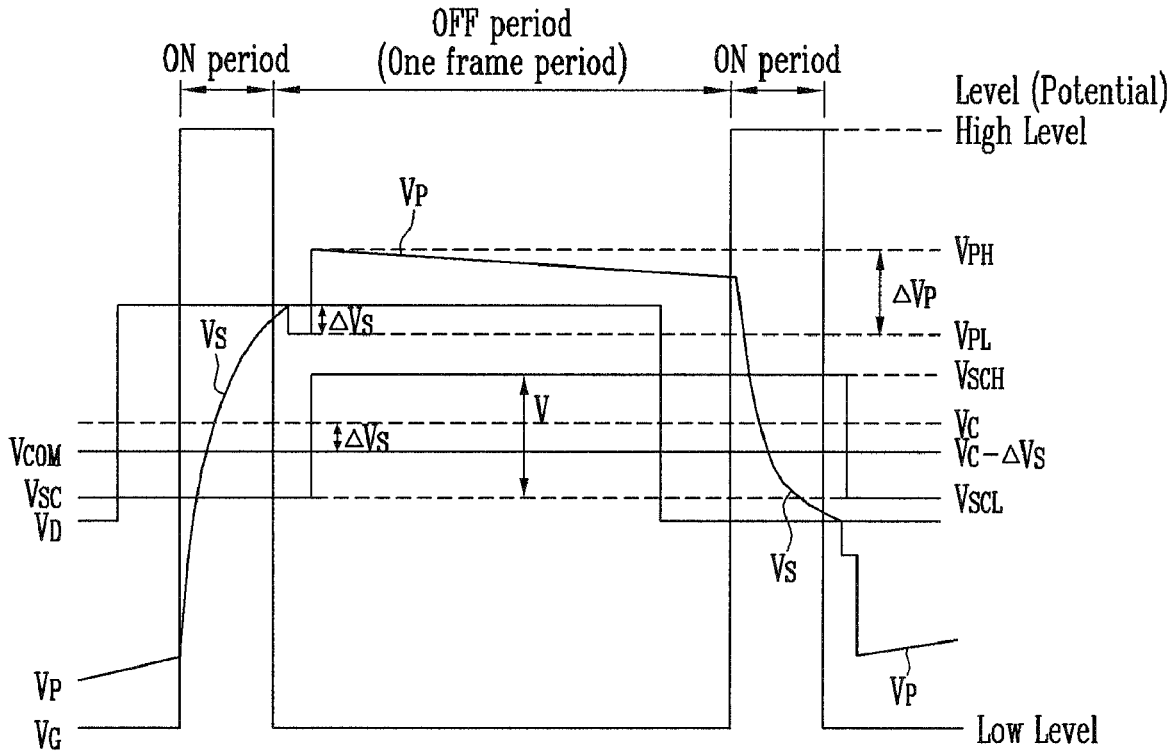
FIG. 6 illustrates a signal timing diagram for selected signals of the liquid crystal cells of FIG. 5.

FIG. 6 illustrates a signal timing diagram for selected signals of the liquid crystal cells of FIG. 5;

In FIG. 6, $V_G$ represents a gate voltage, $V_P$ represents a pixel voltage, $V_S$ represents a source voltage, $V_D$ represents a data voltage, $V_{SC}$ represents an auxiliary voltage, and $V_{COM}$ represents a common voltage. In the illustrated embodiment, the gate voltage $V_G$ is turned on once in one frame period.

Referring to FIG. 6, the gate voltage $V_G$ is applied to the gate lines GL in a period where the gate voltage $V_G$ is driven to a high level. In this period, the TFT is turned on so that electricity flows between the drain electrode and the source electrode. Once the TFT is turned on, the source voltage $V_S$ is at the same level as the data voltage $V_D$ applied by the data lines DLs. The source voltage $V_S$ is applied to first electrodes of the liquid crystal capacitors Clc and the auxiliary capacitors Csc.

When the gate voltage $V_G$ is turned off, the gate voltage $V_G$ is driven to a low level so that the TFT is turned off. After the TFT is turned off, the source voltage $V_S$ is reduced by an amount $\Delta V_S$ such that the level becomes $V_{PL}$.

The common voltage $V_{COM}$ is a substantially constant voltage and is held at the mid-level $V_C$ of the video signal voltage $V_D$ reduced by the change in source voltage $\Delta V_S$.

The auxiliary voltage $V_{SC}$ is inverted after the gate voltage $V_G$ applied to the gate lines GL is reduced and is applied to the auxiliary lines SC. The auxiliary voltage $V_{SC}$ is driven between a high level $V_{SCH}$ and a low level $V_{SCL}$. For example, in a positive polarity period where the source voltage $V_S$ is higher than the common voltage $V_{COM}$, after the gate voltage $V_G$ is reduced, the auxiliary voltage $V_{SC}$ increases from the low level $V_{SCL}$ to the high level $V_{SCH}$. Therefore, the pixel voltage $V_P$ driven by the source voltage $V_S$ and determined as the gate voltage $V_G$ is reduced, increases by a value $\Delta V_P$ because of the increase in the auxiliary voltage $V_{SC}$ stored in the auxiliary capacitor interposed between the pixel electrode and auxiliary line. The pixel voltage $V_P$ is maintained for a period of time in this case almost one frame period, after the gate voltage $V_G$ has been turned off.

As described above, as the auxiliary voltage $V_{SC}$ increases, charges are re-distributed between the liquid crystal capacitors Clc and the auxiliary capacitors Csc such that the pixel voltage $V_P$ increases by $\Delta V_P = V_{PH} - V_{PL}$. In a negative polarity period, where the source voltage $V_S$ is lower than the common voltage $V_{COM}$, and the auxiliary voltage $V_{SC}$ is reduced from a positive value to a negative value, rather than increased as illustrated in FIG. 6, the pixel voltage $V_P$ is reduced by $\Delta V_P$. As a result, the amplitude of the pixel voltage $V_P$ increases so that a voltage applied to the liquid crystal capacitor can increase.

The auxiliary voltage $V_{SC}$ is driven between two levels so that, although the common voltage $V_{COM}$ is a direct current (DC) voltage, a reduced amplitude of the data signal voltage $V_D$ provides sufficient voltage to a liquid crystal capacitor. In general, the capacity of the auxiliary capacitors Csc is significantly larger than that of the liquid crystal capacitors Clc. Therefore, the change in pixel voltage $\Delta V_P$ is controlled by the change in auxiliary voltage $\Delta V$ ($V_{SCH} - V_{SCL}$) for one line. Therefore, the auxiliary voltage is driven between the two levels so that a larger voltage can be applied to and stored in the liquid crystal capacitor (Clc).

In several embodiments, the auxiliary voltage $V_{SC}$ is changed so that the amplitude of the data voltage $V_D$ can be reduced.

Figure 7:
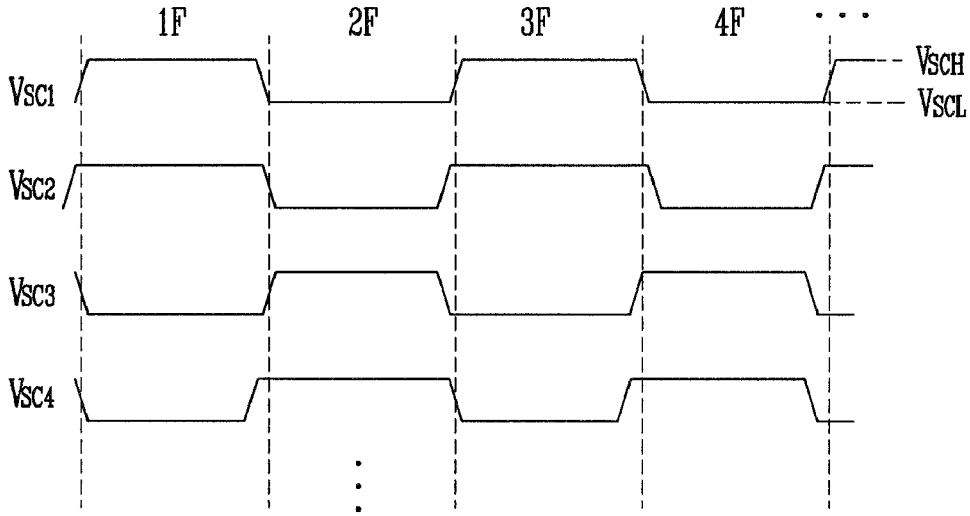
FIG. 7 illustrates a signal timing diagram of voltages in accordance with an inversion method of driving an LCD according to a first embodiment of the present invention.
Figures 8, 9:
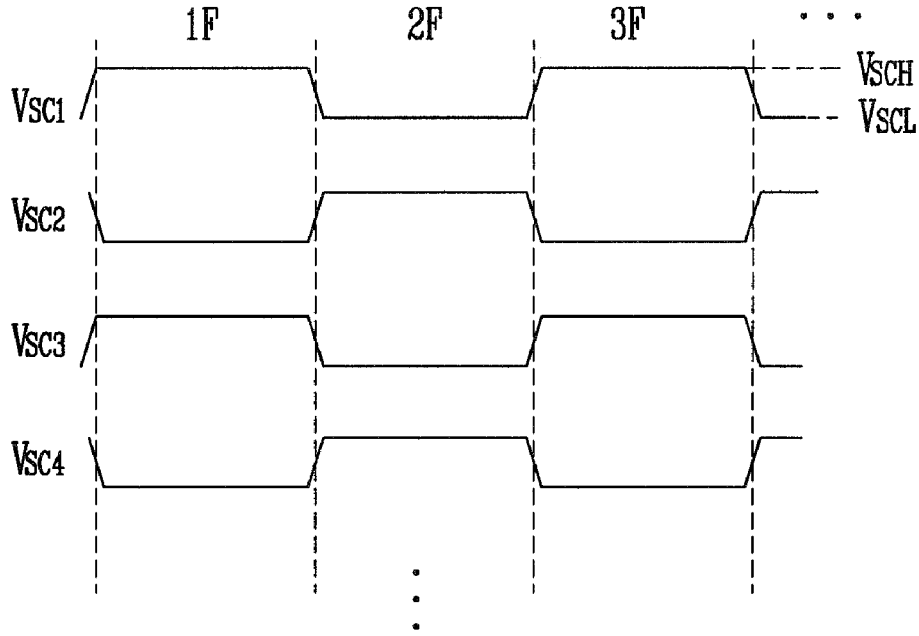
FIG. 8 illustrates the polarity of cells in an LCD using the inversion driving method of FIG. 7.
FIG. 9 illustrates a timing diagram of voltages in accordance with an inversion method of driving an LCD according to a second embodiment of the present invention.

FIG. 7 illustrates a signal timing diagram of voltages in accordance with an inversion method of driving an LCD according to a first embodiment of the present invention. FIG. 8 illustrates the polarity of cells in an LCD using the inversion driving method of FIG. 7.

As illustrated in FIG. 7, a method of driving an LCD, according to a first embodiment of the present invention, is used for the liquid crystal panel described in accordance with the embodiments described in FIGS. 5 and 6. In the embodiment illustrated in FIG. 7, when the auxiliary voltage at a low level ($V_{SCL}$) is increased to a high level ($V_{SCH}$) and supplied to a pair of adjacent auxiliary lines in a first frame period, for example, first and second auxiliary lines SC1 and SC2, the auxiliary voltage at an inverted or opposite level, of $V_{SC1}$ for example, is supplied to a pair of next auxiliary lines, for example, third and fourth auxiliary lines SC3 and SC4.

Then, in a next frame period, e.g., a second frame period, the auxiliary voltages are driven on the respective auxiliary lines at opposite levels to the levels of the first frame period.

In one embodiment, a number of auxiliary lines are used. When the auxiliary voltage is driven from a low level to a high level via a pair of auxiliary lines SCk and SCk+1, adjacent to each other, in a jth frame period, the auxiliary voltage is driven from a high level to a low level or opposite level of the SCk and SCk+1 lines via a pair of next auxiliary lines SCk+2 and SCk+3.

In a next or (j+1)th frame period, the auxiliary voltages are driven on the respective pairs of auxiliary lines at opposite levels to the levels in the jth frame period.

FIG. 8 illustrates the polarity of cells in an LCD using the inversion driving method of FIG. 7.

In the embodiment illustrated in FIG. 8, odd rows are driven using the dot inversion method and even rows are driven using the line inversion method. The dot inversion method and the line inversion method can be combined with each other to reduce or prevent crosstalk, flicker, and audible noise, and to reduce power consumption.

FIG. 9 illustrates a timing diagram of voltages in accordance with a second inversion method of driving an LCD according to one embodiment of the present invention. FIG. 10 illustrates the polarity of cells in an LCD using the inversion driving method of FIG. 9.

As illustrated in FIG. 9, a method of driving an LCD, according to a second embodiment of the present invention, is used in conjunction with the embodiments of liquid crystal panels illustrated in FIGS. 5 and 6. Initially, the auxiliary voltage increases from a low level to a high level and is supplied to the odd auxiliary lines SC1, SC3, . . . SCk, in the first frame period, whereas the auxiliary voltage is reduced from a high level to a low level and is supplied to the even auxiliary capacity lines SC2, SC4, . . . SCk+1 for the first frame period.

In a next frame period, e.g., a second frame period, the auxiliary voltages are driven to opposite levels of the levels of the first frame period for each of the odd and even auxiliary lines SC.

In several embodiments, when the auxiliary voltage increases from a low level to a high level and is supplied to the odd auxiliary lines SC1, SC3 . . . SCk in the jth frame period, the auxiliary voltage is reduced from a high level to a low level for the even auxiliary capacity lines SC2, SC4, . . . SCk+1, in the same frame period.

Then, in the next or (j+1)th frame period, the auxiliary voltages are driven to opposite levels of the levels in the jth frame period for each of the odd and even auxiliary lines.

FIG. 10 illustrates the polarity of cells in an LCD using the inversion driving method of FIG. 9.

In one embodiment, when the liquid crystal cells illustrated in FIG. 5 are implemented, the signals of the auxiliary lines are operated such that the liquid crystal cells can be driven using the conventional inversion methods or using a combination of any of the inversion methods. As described above, any number of conventional inversion methods can be combined to reduce or prevent crosstalk, flicker, and audible noise, and to reduce power consumption.

Although embodiments of the present invention have been shown and described, those skilled in the art would appreciate that changes might be made in these embodiments without departing from the principles and spirit of the invention, the scope of which is defined in the claims and their equivalents.

What is claimed is:

1. A liquid crystal display (LCD), comprising:

a liquid crystal panel partitioned by a plurality of gate lines orthogonal to a plurality of data lines comprising odd data lines and even data lines, the panel comprising a plurality of liquid crystal cells arranged in a matrix and auxiliary lines adjacent to and parallel to the gate lines, the auxiliary lines configured to couple with at least one of the plurality of liquid crystal cells; and an auxiliary driver for driving the auxiliary lines arranged on the liquid crystal panel, wherein the auxiliary driver is configured such that odd rows of the liquid crystal cells are driven by a dot inversion method while even rows of the liquid crystal cells are driven by a line inversion method;

wherein each of the liquid crystal cells comprises an auxiliary capacitor;

wherein the auxiliary lines comprise odd auxiliary lines and even auxiliary lines;

wherein each of the odd auxiliary lines is electrically coupled to the auxiliary capacitor in each of the liquid crystal cells on opposite sides of the odd auxiliary line, where two of the liquid crystal cells at a same column and respectively located on opposite sides of the odd auxiliary line are electrically coupled to the same odd auxiliary line and a same one of the odd data lines; and wherein each of the even auxiliary lines is electrically coupled to the auxiliary capacitor in each of the liquid crystal cells on opposite sides of the even auxiliary line, where two of the liquid crystal cells at a same column and respectively located on opposite sides of the even auxiliary line are electrically coupled to the same even auxiliary line and a same one of the even data lines.

2. The LCD as claimed in claim 1, wherein each of the liquid crystal cells further comprises:

a thin film transistor (TFT) having a gate electrode coupled with an adjacent gate line, among the plurality of gate lines, and coupled between an adjacent data line, among the plurality of data lines, and a first electrode of a liquid crystal capacitor;

the liquid crystal capacitor formed between a pixel electrode coupled with a source electrode of the TFT and a common electrode; and the auxiliary capacitor formed between the source electrode of the TFT and a corresponding one of the auxiliary lines.

3. The LCD as claimed in claim 1, wherein the odd auxiliary lines are adjacent to and parallel to odd gate lines and are coupled with the auxiliary capacitors in the liquid crystal cells on opposite sides of the odd auxiliary lines among the liquid crystal cells coupled with the odd data lines that cross the odd auxiliary lines.

4. The LCD as claimed in claim 1, wherein the even auxiliary lines are adjacent to and parallel to even gate lines and are coupled with the auxiliary capacitors in the liquid crystal cells on opposite sides of the even auxiliary lines among the liquid crystal cells coupled with the even data lines that cross the even auxiliary lines.

5. A method of driving an LCD comprising a liquid crystal panel partitioned by a plurality of gate lines and data lines and including a plurality of liquid crystal cells arranged in a matrix and auxiliary lines adjacent to and parallel to the gate lines, the auxiliary lines coupled with the plurality of liquid crystal cells, the method comprising:

supplying a first auxiliary voltage that increases from a low level to a high level on a first pair of auxiliary lines adjacent to each other for a $j^{th}$ frame period;

supplying a second auxiliary voltage that decreases from a high level to a low level on a second pair of auxiliary lines adjacent to each other for the $j^{th}$ frame period, the first auxiliary voltage and the second auxiliary voltage being supplied concurrently; and supplying the auxiliary voltages at levels opposite to the levels of the $j^{th}$ frame period on the first and second pairs of auxiliary lines in a $(j+1)^{th}$ frame period, wherein odd rows of the liquid crystal cells are driven by a dot inversion method while even rows of the liquid crystal cells are driven by a line inversion method.

6. The method as claimed in claim 5, wherein each of the liquid crystal cells further comprises:

a thin film transistor (TFT) having a gate electrode coupled with an adjacent gate line, among the plurality of gate lines, and coupled between an adjacent data line, among the plurality of data lines, and a first electrode of a liquid crystal capacitor;

the liquid crystal capacitor formed between a pixel electrode coupled with a source electrode of the TFT and a common electrode; and an auxiliary capacitor formed between the source electrode of the TFT and a corresponding one of the auxiliary lines.

7. The method as claimed in claim 6, wherein:

the auxiliary lines comprise odd auxiliary lines and even auxiliary lines;

the gate lines comprise odd gate lines and even gate lines;

the data lines comprise odd data lines and even data lines; and the odd auxiliary lines are adjacent to and parallel to the odd gate lines and are coupled with the auxiliary capacitors in the liquid crystal cells on opposite sides of the odd auxiliary lines among the liquid crystal cells coupled with the odd data lines that cross the odd auxiliary lines.

8. The method as claimed in claim 6, wherein:

the auxiliary lines comprise odd auxiliary lines and even auxiliary lines;

the gate lines comprise odd gate lines and even gate lines;

the data lines comprise odd data lines and even data lines; and the even auxiliary lines are adjacent to and parallel to the even gate lines and are coupled with the auxiliary capacitors in the liquid crystal cells on opposite sides of the even auxiliary lines among the liquid crystal cells coupled with the even data lines that cross the even auxiliary lines.

9. The method of claim 6, wherein:

the supplying the first and second auxiliary voltages respectively on the first and second pairs of auxiliary lines comprises charging the plurality of auxiliary capacitors.

10. The method of claim 5, further comprising:

supplying a voltage to the plurality of gate lines.

11. The method of claim 5, further comprising:

supplying a voltage to the plurality of data lines.

12. The method of claim 11, further comprising:

reducing the voltage supplied to the plurality of data lines based, at least in part, on the supplying the first and second auxiliary voltages respectively on the first and second pairs of auxiliary lines.

* * * * *